US008586517B2

(12) United States Patent
Waynick

(10) Patent No.: US 8,586,517 B2
(45) Date of Patent: Nov. 19, 2013

(54) MIXED BASE PHENATES AND SULFONATES

(75) Inventor: John A. Waynick, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 1212 days.

(21) Appl. No.: 11/417,001

(22) Filed: May 3, 2006

(65) Prior Publication Data

US 2007/0060485 A1 Mar. 15, 2007

Related U.S. Application Data

(60) Provisional application No. 60/677,042, filed on May 3, 2005.

(51) Int. Cl.
*C10M 159/22* (2006.01)
*C10M 159/24* (2006.01)

(52) U.S. Cl.
USPC ..... 508/392; 508/435; 508/460; 508/390

(58) Field of Classification Search
USPC ..... 508/390, 392, 360, 435, 460
See application file for complete search history.

(56) References Cited

U.S. PATENT DOCUMENTS

| | | | | |
|---|---|---|---|---|
| 4,137,187 | A | 1/1979 | Lowe | 252/46.6 |
| 4,159,252 | A | 6/1979 | Wainwright et al. | |
| 4,164,472 | A | 8/1979 | Cheng et al. | 252/18 |
| 4,328,111 | A * | 5/1982 | Watson et al. | 508/393 |
| RE31,611 | E | 6/1984 | Wainwright et al. | |
| 4,493,776 | A * | 1/1985 | Rhodes | 508/287 |
| 4,543,195 | A | 9/1985 | Grangette et al. | |
| 4,830,767 | A | 5/1989 | Waynick | |
| 4,986,923 | A | 1/1991 | Waynick | |
| 5,102,565 | A | 4/1992 | Waynick | |
| 5,147,571 | A * | 9/1992 | DeRosa et al. | 508/260 |
| 5,158,694 | A | 10/1992 | Waynick | 252/18 |
| 5,207,935 | A | 5/1993 | Waynick | |
| 5,223,161 | A | 6/1993 | Waynick | |
| 5,232,614 | A | 8/1993 | Colclough et al. | |
| 5,320,765 | A | 6/1994 | Fetterman, Jr. et al. | 252/32.7 |
| 5,401,424 | A | 3/1995 | Vinci et al. | |
| 5,460,737 | A | 10/1995 | Sakai et al. | |
| 5,464,548 | A | 11/1995 | Cahoon et al. | |
| 5,523,006 | A | 6/1996 | Strumban | |
| 5,652,201 | A | 7/1997 | Papay et al. | |
| 5,712,230 | A | 1/1998 | Abraham et al. | |
| 5,877,130 | A | 3/1999 | Kohara et al. | |
| 6,046,144 | A | 4/2000 | Karol et al. | 508/279 |
| 6,140,279 | A * | 10/2000 | Emert et al. | 508/192 |
| 6,310,011 | B1 * | 10/2001 | Karn et al. | 508/460 |
| 6,531,428 | B2 | 3/2003 | Nakazato et al. | |
| 6,599,867 | B2 | 7/2003 | Hammond et al. | |
| 7,419,941 | B2 | 9/2008 | Waynick | |
| 2002/0142922 | A1 * | 10/2002 | Yagishita et al. | 508/374 |
| 2003/0134756 | A1 * | 7/2003 | Carrick et al. | 508/398 |
| 2003/0139302 | A1 | 7/2003 | Akada et al. | |
| 2003/0166474 | A1 * | 9/2003 | Winemiller et al. | 508/192 |
| 2004/0048753 | A1 | 3/2004 | Ritchie et al. | 208/232 |
| 2004/0235678 | A1 | 11/2004 | Di Biase et al. | |
| 2004/0235684 | A1 | 11/2004 | Cook et al. | |
| 2004/0235688 | A1 | 11/2004 | Locke et al. | |
| 2005/0137098 | A1 | 6/2005 | Le Coent et al. | 508/392 |
| 2005/0269548 | A1 | 12/2005 | Jeffcoate et al. | 252/71 |
| 2007/0060485 | A1 * | 3/2007 | Waynick | 508/388 |

FOREIGN PATENT DOCUMENTS

| | | |
|---|---|---|
| WO | 01/27226 | 4/2001 |
| WO | 2006119502 A3 | 11/2006 |

OTHER PUBLICATIONS

International Search Report, PCT Patent Application No. PCT/US06/17101, "*Mixed Base Phenates and Sulfonates*," May 3, 2006.

International Search Report and Written Opinion dated Aug. 8, 2007 issued in related International Application No. PCT/US06/17101 (6 pages).

International Search Report and written Opinion dated Aug. 29, 2007 issued in related International Application No. PCT/US0617564 (9 pages).

U.S. Office Action dated Sep. 2, 2009 issued in related U.S. Appl. No. 11/417,276.

U.S. Office Action dated Nov. 26, 2008 issued in related U.S. Appl. No. 11/417,276.

U.S. Office Action dated Jun. 23, 2010 issued in related U.S. Appl. No. 11/417,276.

U.S. Office Action, mail date Nov. 8, 2011 issued in related U.S. Appl. No. 11/417,276.

U.S. Office Action, mail date May 31, 2012 issued in related U.S. Appl. No. 11/417,276 (9 pgs).

Bearchell, et al., Phys. Chem. Chem. Phys. (PCCP), 2000, 2, pp. 5197-5207; "Experimental and Molecular Modelling Studies of Overbased Detergent Particles."

* cited by examiner

*Primary Examiner* — Jim Goloboy
(74) *Attorney, Agent, or Firm* — Grossman, Tucker et al

(57) ABSTRACT

A lubricant composition. The lubricant composition includes (a) a phenate, a sulfonate, or both; and (b) a base composition wherein the base composition is (i) a metal carbonate and a metal sulfate, (ii) a metal sulfate and a metal phosphate; (iii) a metal sulfate and a metal carboxylate; (iv) a metal phosphate and a metal carboxylate; or (v) three-way or four-way combination of a metal sulfate, a metal carboxylate, a metal phosphate, and a metal carbonate; and (c) a lubricating oil or a grease.

16 Claims, No Drawings

MIXED BASE PHENATES AND SULFONATES

This application claims priority to U.S. provisional application Ser. No. 60/677,042, filed May 3, 2005, incorporated herein in its entirety.

BACKGROUND OF THE INVENTION

This invention pertains to overbased phenates and sulfonates that contain mixtures of bases, which exhibit anti-wear properties. This invention also pertains to lubricant compositions containing the mixed base phenates and sulfonates.

Various additives can be added to lubricating oils in order to improve various oil properties. Anti-wear agents are intended to decrease wear of machine parts. Additives have been and continue to be developed for use in such oil compositions to improve the lubricating characteristics thereof and thereby to lessen the wear of the moving parts.

Lubricating oils tend to deteriorate under the conditions of use in present day automotive engines, with attendant formations of sludge and lacquer and resinous materials which adhere to the engine parts, thereby lowering the operating efficiency of the engine. Detergents and dispersants are added to the lubricating oil to keep the deposit forming materials suspended in oil so that the engine is kept clean and in efficient operation condition for extended periods of time.

Some common additives used in lubricating oils are metal sulfonates and phenates. In many cases, these additives are overbased, that is, contain a molar excess of base over that needed to neutralize the sulfonic acid or phenolic material. Overbased metal sulfonates are commonly used in lubricating oil compositions as rust inhibitors and detergents. Overbased phenates, including sulfurized phenates, are commonly used in lubricating oil compositions as detergents and antioxidants.

SUMMARY OF THE INVENTION

The inventor has determined that overbased phenates and sulfonates which contain combinations of base compounds provide, unexpectedly, synergistic anti-wear properties.

It is believed that the lubricant and grease that contain the overbased phenates and/or sulfonates of this invention provides improved anti-wear properties and friction reduction.

In one broad respect, this invention is an anti-wear composition, comprising: (a) a phenate, a sulfonate, or both; and (b) a base composition wherein the base composition is (i) a metal carbonate and a metal sulfate, (ii) a metal sulfate and a metal phosphate; (iii) a metal sulfate and a metal carboxylate; (iv) a metal phosphate and a metal carboxylate; or (v) three-way or four-way combination of a metal sulfate, a metal carboxylate, a metal phosphate, and a metal carbonate. This anti-wear composition is also referred to herein as an anti-wear additive and a mixed base anti-wear composition.

In another broad respect, this invention is an lubricant composition, comprising: (a) a phenate, a sulfonate, or both; and (b) a base composition wherein the base composition is (i) a metal carbonate and a metal sulfate, (ii) a metal sulfate and a metal phosphate; (iii) a metal sulfate and a metal carboxylate; (iv) a metal phosphate and a metal carboxylate; or (v) three-way or four-way combination of a metal sulfate, a metal carboxylate, a metal phosphate, and a metal carbonate; and (c) a lubricating oil or a grease.

In another broad respect, this invention is a method of manufacturing an anti-wear composition, comprising: combining (a) a phenate, a sulfonate, or both; and (b) a base composition wherein the base composition is (i) a metal carbonate and a metal sulfate, (ii) a metal sulfate and a metal phosphate; (iii) a metal sulfate and a metal carboxylate; (iv) a metal phosphate and a metal carboxylate; or (v) three-way or four-way combination of a metal sulfate, a metal carboxylate, a metal phosphate, and a metal carbonate.

In another broad respect, this invention is a method of manufacturing an lubricant composition, comprising: combining (a) a phenate, a sulfonate, or both; (b) a base composition wherein the base composition is (i) a metal carbonate and a metal sulfate, (ii) a metal sulfate and a metal phosphate; (iii) a metal sulfate and a metal carboxylate; (iv) a metal phosphate and a metal carboxylate; or (v) three-way or four-way combination of a metal sulfate, a metal carboxylate, a metal phosphate, and a metal carbonate; and (c) a lubricating oil or a grease.

In another broad respect, this invention is a method of manufacturing an anti-wear composition, comprising: reacting (a) a phenate overbased with a metal carbonate, a sulfonate overbased with a metal carbonate, or both with (b) a sulfuric acid, or sulfuric acid and phosphorous acid, or sulfuric acid and a carboxylic acid or anhydride, or phosphoric acid and a carboxylic acid or anhydride, or sulfuric acid, phosphoric acid, and carboxylic acid or anhydride.

The anti-wear compositions of this invention as well as the lubricant oils and greases containing the anti-wear compositions of this invention may be optionally augmented with other anti-wear additives such as graphite and molybdenum disulfide, as well as other additives commonly employed in lubricants and greases. Alternatively, such other anti-wear additives can be omitted. The grease may be further augmented in its composition by a boron-containing material to further inhibit oil separation.

DETAILED DESCRIPTION OF THE INVENTION

Overbased metal sulfonates are commonly used in lubricating oil compositions as rust inhibitors and detergents. Overbased phenates, including sulfurized phenates, are commonly used in lubricating oil compositions as detergents and antioxidants. Two of the most common classes of metal sulfonates and phenates are overbased magnesium sulfonate and overbased calcium phenate. In general, overbased magnesium sulfonates comprises overbased alkyl benzene sulfonate comprising about 4 to about 100 carbon atoms in the alkyl group, and having a total base number from about 100 to about 500 based on thirty percent soap. In one embodiment, overbased calcium phenates comprises overbased alkyl substituted phenate having about 4 to about 100 carbon atoms in the alkyl group, and having a total base number from about 100 to about 600 based on thirty percent soap.

In general, oil soluble overbased metal sulfonates are made by reacting a metal base with oil-soluble sulfonic acids. Oil-soluble sulfonic acids can be aliphatic or aromatic compounds. Aromatic sulfonic acids are the oil-soluble petroleum sulfonic acids, sometimes referred to as "mahogany acids," aryl sulfonic acids, and alkaryl sulfonic acids. Illustrative of such sulfonic acids are dilauryl benzene sulfonic acid, lauryl cetyl benzene sulfonic acid, paraffin-substituted benzene sulfonic acids, polyolefin alkylated benzene sulfonic acids, such as polybutylene alkylated benzene sulfonic acids in which the polybutylene substituents have molecular weight of at least about 100, and preferably within the range of from about 100 to about 10,000, and polypropylene alkylated benzene sulfonic acids in which the polypropylene substituents have a molecular weight of at least about 80 and preferably within the range of from about 80 to about 10,000. Examples of sulfonic acids are diparaffin wax-substituted phenol sulfonic acids, acetyl chlorobenzene sulfonic acids, cetyl-phenol disulfide sulfonic acids, cetyl-phenol monosulfide sulfonic acids, and cetoxy capryl benzene sulfonic acids. Oil-soluble sulfonic acids are well described in the art, such as for example U.S. Pat. Nos. 2,616,604; 2,626,207; and 2,767,209, and others.

Some metal salts of the above compounds have the formula $[SO_3—A—R]_nM_1$ where A is a substituted benzene ring; R is alkyl or hydroxy, chloro or bromo hydrocarbyl; $M_1$ is magnesium, calcium, barium, or mixtures thereof; and n is 2. In some cases the R group can be made by polymerizing $C_2$-$C_6$ olefins to a molecular weight in the range of about 80 to about 10,000, preferably about 80 to about 1,000, and then attaching said group to a benzene ring by well known alkylation techniques. R can be a variety of hydrocarbon moieties or substituted hydrocarbon which results in an oil soluble benzene sulfonic acid or salt thereof. For example, R can be a low molecular weight alkyl such as iso-butyl, nonyl, dodecyl, and the like; an intermediate molecular weight hydrocarbyl such as $C_{15}$-$C_{100}$ polybutene or polypropylene polymers; a higher molecular weight hydrocarbyl such as polyolefin having a number average molecular weight of 10,000, and others. R can be substituted with groups such as chlorine, bromine, hydroxy, nitro, or sulfonic acid groups. Also, the benzene ring of the sulfonic acid may have more than one substituent alkyl, or hydroxy, halo, nitro or sulfonic acid alkyl groups.

Non-aromatic sulfonic acids are generally made by the sulfonation of most any aliphatic hydrocarbon such as alkanes, alkenes, and the like. Also, the hydrocarbyl may contain various substitutions which do not interfere with later reactions or end use. One group of non-aromatic sulfonic acids is made by the sulfonation of polymers or copolymers, such as polymerized or copolymerized olefins. The term polymer olefins as used herein refers to amorphous polymers and copolymers derived from olefinically unsaturated monomers. Such olefin monomers include olefins of the general formula $RCH{=}CH_2$, in which R comprises aliphatic or cycloaliphatic radical of from 1 to about 20 carbon atoms, for example, propene, isobutylene, butene-1,4-methyl-1-pentene, decene-1, vinylidene norbornene, 5-methylene-2-norbornene, etc. Other olefin monomers having a plurality of double bonds may be used, in particular diolefins containing from about 4 to about 25 carbon atoms, e.g., 1,4-butadiene, 2,3-hexadiene, 1,4-pentadiene, 2-methyl-2,5-hexadiene, 1,7-octadiene, etc. These polyolefins have number average molecular weights from about 36 to about 10,000 or higher, but preferably from about 80 to about 10,000. Representative examples of these materials include polypropylene or polybutylene polymers. The olefin may be a copolymer, such as an ethylene propylene copolymer or ethylene-propylene-hexadiene terpolymer, or others.

The preparation of the sulfonic acids is well known. For example, sulfonic acids can be prepared by reacting the material to be sulfonated with a sulfonating agent, such as concentrated sulfuric acid, fuming sulfuric acid, chlorosulfonic acid or sulfur trioxide for a period of time sufficient to effect sulfonation, and thereafter separating insoluble acid sludge from the oil-soluble sulfonic acid. Overbased sulfonates are commonly made by the reaction of sulfonic acid with metal bases such as the oxide, hydroxide, or carbonate of calcium, magnesium or barium. In some cases the sulfonate can be made from the metal itself or a derivative of said metal. Representative processes for making overbased sulfonates are described in U.S. Pat. Nos. 3,126,340; 3,492,230; 3,524,814 and 3,609,076, incorporated herein by reference. The carbonate overbased magnesium sulfonates are preferably made from magnesium oxide and carbon dioxide in the presence of a promoter such as ethylene diamine or ammonia. However, some overbased sulfonates contain no carbonate.

Phenates are generally the reaction product of phenol or substituted phenol with a metal base. In some cases, phenates also contain sulfur.

Substituted phenols are generally mono-, di-, or tri-hydrocarbyl substituted, such as alkyl, alkenyl, aryl, aralkyl or alkaryl. Typically the phenols are monoalkyl substituted. The hydrocarbyl can comprise low molecular weight groups such as methyl, ethyl, the isomers of propyl, butyl, pentyl, hexyl, heptyl, octyl, nonyl, decyl, and the like, up to high molecular weight materials having a number average molecular weight of 10,000 or more. These hydrocarbyl substituents can be polymer olefins previously described. Representative hydrocarbyl substituents have a molecular weight of about 80 to about 10,000, in one embodiment from about 80 to about 200. Many commercially available substituted phenols contain about $C_4$ to about $C_{100}$, in one embodiment $C_8$ to $C_{20}$ substituents from polypropylene or polybutene. The hydrocarbon substituted phenol may have other substituents, such as for example, chlorine, bromine, nitro or sulfonic acid groups so long as such substitution does not interfere with the various reactions nor adversely affect the utility of the composition.

The base used to overbase the phenate and/or sulfonate is typically a metal oxide, hydroxide, or a carbonate. Common metals are calcium, barium, strontium, and magnesium. Typically the base is calcium oxide, calcium carbonate, or calcium hydroxide. Some metal phenates can be represented by the following hypothetical structure: $M_2[O—A—R_a]_2$ where A is a substituted benzene group; $M_2$ is a Group II metal; R is a hydrocarbyl group and a is independently in each occurrence 1, 2, 3, or 4. However, because the metal phenate is overbased, this structure may be inaccurate in that an excess of metal base is commonly associated with the above structure.

Some sulfur containing phenates can be represented by the following hypothetical structure: $M_2[—O—AR_a—S_x—AR_a—O—]$ where A is a substituted benzene group; $M_2$ is a Group II metal, R is a hydrocarbyl group, a is independently in each occurrence 1, 2, 3, or 4; and x is 1, 2, 3, or 4. In this structure, alternatively, three or more phenol residues can be connected by $—S_x—$ bridges. However, because the sulfur containing metal phenate is overbased, this structure may be inaccurate in that an excess of metal base is commonly associated with the above structures.

Oftentimes, phenates contain sulfur, such as a sulfur bridge between two phenyl groups containing one, two, three, four, or more sulfur atoms. In some cases, several phenols or substituted phenols are bridged together by a number of sulfur bridges. The sulfur can be introduced by the reaction of elemental sulfur or $SCl_2$ with phenol or substituted phenol, or by the reaction of elemental sulfur or $SCl_2$ with metal phenate.

Methods of making various phenates and sulfur containing phenates and overbasing can be found in U.S. Pat. Nos. 3,966,621; 3,969,235; 3,953,519; 3,932,289; 3,923,670; 3,801,507; 3,036,971; 3,810,837; 3,761,414; 3,336,224; 3,178,368; 3,437,595; and 3,464,970, incorporated herein by reference.

The mixed base sulfonate and/or phenate anti-wear compositions of this invention are generally manufactured by reacting at reaction conditions overbased metal sulfonate, phenate, or mixtures thereof, with acidic compound comprising sulfuric acid, organic carboxylic acid, organic carboxylic acid anhydride, phosphoric acid, phosphoric acid ester, thiophosphoric acid ester, or mixtures thereof. Commonly, the reaction is conducted at ambient temperatures, such as above 32 degrees F. (0 degree C., in one embodiment from about 75 degrees F. (24 degrees C.) to about 250 degrees F. (121 degrees C), in another embodiment from about 100 degrees F. (38 degrees C.) to about 200 degree F. (93 degrees C.). Ambient pressures are typically employed, typically about one atmosphere. In some cases, it is helpful to use water or methanol in order to promote the reaction of acidic compound with basic compound. The desirability of using such a promoter can be determined by routine testing. Often the reaction is conducted in a solvent, such as a light hydrocarbon or lubricating oil. Sequential addition of one or more acids can also be employed.

The acids used to form the mixed base phenates and/or sulfonates of this invention include those capable of reacting with sulfonate, phenate, or mixtures thereof overbased with carbonate, thereby improving the properties of said overbased material. The acidic compound reacts with the carbonate to form a metal sulfate, metal phosphate, or metal carboxylate. Depending on the amount of acid or acids used, the metal base initially present in the starting overbased material may be present in the final product or essentially fully reacted. The resulting composition possesses or compositions possess improved anti-wear properties. Because not all organic carboxylic acids or anhydrides, phosphoric acid or acid esters, sulfuric acid, or mixtures thereof improve the various above mentioned properties, they must be tested and determined empirically. Another method of forming the mixed base phenates and/or sulfonates is by initially mixing the phenate and/or sulfonate during the overbasing process to form a mixed base composition. For example, sodium carbonate and sodium sulfate may be added to a phenate to form an overbased composition.

In some cases the compositions can be made by reacting acidic compound with overbased phenates and/or sulfonates. For example, in the manufacture of overbased metal sulfonates and phenates, acidic compound can be added to the reaction mixture after the overbased metal sulfonate or phenate is substantially formed. This is conveniently done by contacting the overbased material in a solvent with the acidic compound at a temperature from about 75 degrees F to about 250 degrees F. for a time sufficient to incorporate at least a portion of the acid. Preferably, a substantial portion of the acid is incorporated. In some cases, it may be possible to conduct the reaction at higher or lower temperatures. Higher temperatures generally lead to faster reaction time but can also lead to some decomposition. Reaction conditions are generally selected to maintain sufficiently fast reaction periods while maintaining product quality by minimizing decomposition. The acidic compound can be added in one batch or added incrementally, in a controlled manner, to the overbased phenate and/or sulfonate.

The reaction can be carried out at atmospheric pressure, although either pressure or vacuum systems may be used. In some cases it is desirable to blanket the reaction mixture with an inert gas, such as nitrogen, in order to minimize oxidation, degradation, and unwanted side reactions. The reactants should be mixed so that the basic material and acidic material can be readily contacted. The reaction can be carried out on a batch basis where the reactants are introduced into a reaction zone such as a stirred reactor, the reaction carried out and the product removed; or on a continuous basis where controlled proportions of reactants are continuously contacted together at one end of a reaction zone, and product removed from another end of the reaction zone.

The compositions can be formed over wide ranges of overbased compound to acidic compound. When a metal carbonate and a metal sulfate are desired and a metal carbonate is initially present as the base of the overbased phenate and/or sulfonate, then sufficient sulfuric acid is reacted with the carbonate so that the weight ratio of sulfate to carbonate in the final product is from about 1:10 to about 10:1, in one embodiment from about 1:4 to about 4:1, in another embodiment from about 1:3 to about 3:1, in another embodiment from about 1:2 to about 2:1, and in one particular embodiment about 1:1. Alternatively, the sulfuric acid is reacted with the carbonate prior to overbasing of the phenate and/or sulfonate. In another alternative, metal sulfate is simply added to the overbased phenate and/or sulfonate to bring the ratio to the desired ratio. Likewise, combinations of these techniques can be used to make the anti-wear additive of this invention. Alternatively, if a hydroxide or oxide is present as the base of the overbased phenate and/or sulfonate, then carbon dioxide can be, e.g., bubbled through the composition which reacts to form carbonate and sulfuric acid can be added which also reacts with the hydroxide or oxide to form sulfate.

If a hydroxide or oxide is present in the overbased phenate and/or sulfonate, and if a mixed base is desired with other than carbonate, then the sulfuric acid, phosphoric acid, and/or carboxylic acid or anhydride, and combinations thereof, can be reacted with the overbased phenate and/or sulfonate to form the final mixed base phenate and/or sulfonate, containing a combination of sulfate, phosphate, and carboxylate. Alternatively, carbon dioxide can be bubbled through the overbased phenate and/or sulfonate containing the hydroxide or oxide to thereby convert the hydroxide or oxide base present into carbonate.

When a metal sulfate and a metal phosphate overbasing are desired and a metal carbonate is initially present as the base of the overbased phenate and/or sulfonate, then sufficient sulfuric acid and phosphoric acid are reacted (either sequentially or contemporaneously) with the carbonate so that the weight ratio of sulfate to phosphate in the final product is from about 1:10 to about 10:1, in one embodiment from about 1:4 to about 4:1, in another embodiment from about 1:3 to about 3:1, in another embodiment from about 1:2 to about 2:1, and in one particular embodiment about 1:1. Alternatively, the sulfuric acid and phosphoric acid are reacted with the carbonate prior to overbasing of the phenate and/or sulfonate. In another alternative, metal sulfate or metal phosphate is simply added to the overbased phenate and/or sulfonate to bring the ratio to the desired ratio, and then the balance of the carbonate is reacted with either sulfuric acid or phosphoric acid, as appropriate. In still another alternative, if the overbased phenate and/or sulfonate contains hydroxide or oxide as the base, then sulfuric acid and phosphoric acid can be reacted in the desired proportions to form the final mixed base phenate and/or sulfonate anti-wear additive. Likewise, combinations of these techniques can be used to make the anti-wear additive of this invention.

When a metal sulfate and a metal carboxylate overbasing are desired and a metal carbonate is initially present as the base of the overbased phenate and/or sulfonate, then sufficient sulfuric acid and carboxylic acid or anhydride are reacted (either sequentially or contemporaneously) with the carbonate so that the weight ratio of sulfate to carboxylate in the final product is from about 1:10 to about 10:1, in one embodiment from about 1:4 to about 4:1, in another embodiment from about 1:3 to about 3:1, in another embodiment from about 1:2 to about 2:1, and in one particular embodiment about 1:1. Alternatively, the sulfuric acid and carboxylic acid or anhydride are reacted with the carbonate prior to overbasing of the phenate and/or sulfonate. In another alternative, metal sulfate or metal carboxylate is simply added to the overbased phenate and/or sulfonate to bring the ratio to the desired ratio, and then the balance of the carbonate is reacted with either sulfuric acid or carboxylic acid or anhydride, as appropriate. Likewise, combinations of these techniques can be used to make the anti-wear additive of this invention.

When a metal carboxylate and a metal phosphate overbasing are desired and a metal carbonate is initially present as the base of the overbased phenate and/or sulfonate, then sufficient carboxylic acid or anhydride and phosphoric acid are reacted (either sequentially or contemporaneously) with the carbonate so that the weight ratio of carboxylate to phosphate in the final product is from about 1:10 to about 10:1, in one embodiment from about 1:4 to about 4:1, in another embodiment from about 1:3 to about 3:1, in another embodiment from about 1:2 to about 2:1, and in one particular embodiment about 1:1. Alternatively, the carboxylic acid or anhydride and phosphoric acid are reacted with the carbonate prior to overbasing of the phenate and/or sulfonate. In another alternative, metal carboxylate or metal phosphate is simply added to the overbased phenate and/or sulfonate to bring the ratio to the desired ratio, and then the balance of the carbonate is reacted with either carboxylic acid or anhydride, or phosphoric acid, as appropriate. Likewise, combinations of these techniques can be used to make the anti-wear additive of this invention.

When combinations of three or four of the metal carbonate, metal sulfate, metal phosphate, and metal carboxylate overbasing are desired and a metal carbonate is initially present as the base of the overbased phenate and/or sulfonate, then sufficient sulfuric acid, phosphoric acid, and/or carboxylate acid or anhydride (as well as carbon dioxide if the starting overbased phenate and/or sulfonate contains hydroxide or oxide) are reacted with the carbonate to form the desired ratio of the three or four components. In the three and four component systems, the amount of each base present can vary widely. If present, the weight ratio of sulfate in the mixed base phenate and/or sulfonate to the total amount of other base present can be from about 1:1000 to about 1000:1. If present, the weight ratio of phosphate in the mixed base phenate and/or sulfonate to the total amount of other base present can be from about 1:1000 to about 1000:1. If present, the weight ratio of carbonate in the mixed base phenate and/or sulfonate to the total amount of other base present can be from about 1:1000 to about 1000:1. If present, the weight ratio of carboxylate in the mixed base phenate and/or sulfonate to the total amount of other base present can be from about 1:1000 to about 1000:1.

As an alternative to the procedure discussed above, the mixed base phenate and/or sulfonate can be made in essentially two or more batches by converting all of the hydroxide, oxide or carbonate to a desired overbased material (e.g., all sulfate). Next, all of the hydroxide, oxide or carbonate can be converted to a desired base material (e.g. phosphate) in a second batch. The resulting batches can then be blended together to form the final mixed base phenate and/or sulfonate, with a desired weight ratio of first base to second base. Likewise, this procedure can be used to form three-component and four-component mixed base phenates and/or sulfonates.

The mixed base phenate and/or sulfonate anti-wear additive composition of this invention is generally added to lubricating oil and grease in order to improve various properties of said oil or grease. Depending on the nature of the oil or grease, the intended use and the desired improvement, different amounts of the additive may be needed in order to be effective. The anti-wear additive is generally present in a lubricating oil or grease at a concentration of about 0.01 to about 50 weight percent, preferably about 0.05 to about 20 weight percent, still more preferably about 0.5 to about 5 weight percent.

In most cases, overbased metal sulfonates or phenates are dissolved or suspended in a solvent or oil so that they can be easily transported and dissolved or suspended as additives in lubricating oil. Therefore, such materials are commonly purchased or manufactured with lubricating oil present. Additional oil may be added if desired for the reaction of basic compound with acidic compound in order to reduce viscosity, improve filterability and processability, and the like. It is generally desirable to use diluent lubricating oil of such a quality so that it can remain unseparated in the product and not adversely affect end use. Other diluents such as naphtha, light hydrocarbons, especially $C_5$-$C_8$ hydrocarbons, are more effective at reducing viscosity but most often must be removed from the final product.

The organic carboxylic acids or acid anhydrides of this invention can vary in molecular weight from extremely low on up to extremely high molecular weight compounds. Generally, the viscosity of such compounds increases with molecular weight and less moles are contained in a given weight. Therefore, it is generally desirable to use acids and anhydrides containing less than 1,000 carbon atoms to aid manufacture of the final product and to prevent the acidic compound from contributing too greatly in weight to the final product.

The organic carboxylic acids can be straight chain or branched, saturated, unsaturated or aromatic. Often an acid will fall within more than one of these categories. The acids may contain substituents such as chlorine, bromine, hydroxy, nitro, oxygen such as ketone, and other groups so long as such substitution is not detrimental to the final product.

Some carboxylic acids are saturated acids such as formic, acetic, propionic, butyric, valeric, caproic, caprylic, capric, lauric, myristic, palmitic, stearic, and branched isomers thereof; unsaturated acids such as oleic, linoleic, linolenic, acrylic, methacrylic, undecylinic; aromatic acids such as benzoic, toluic, chlorobenzoic, bromobenzoic, nitrobenzoic, phthalic, isophthalic, terephthalic, salicylic, hydroxybenzoic, anthranilic, aminobenzoic, methoxybenzoic, hemimellitic, trimellitic, trimesic; dicarboxylic acids such as oxalic, malonic, succinic, glutaric, adipic, pimelic, suberic, azelaic, sebacic, maleic, fumaric, dimerized acids of same or different acids which can be made by the condensation of unsaturated carboxylic acids. Anhydrides of the various dicarboxylic acids, especially vicinal dicarboxylic acids, are representative acidic compounds for the practice of this invention.

One particular group of carboxylic acids or anhydrides thereof are alkyl or alkenyl substituted dicarboxylic acids or anhydrides thereof. One such acid is alkenyl substituted succinic acid or anhydride. These substituted acids or anhydrides commonly have from about 8 to about 1,000 carbon atoms, preferably about 10 to about 56 carbon atoms, in the alkenyl group. Substituted succinic anhydride is often made by the reaction of maleic anhydride with olefinic materials. Some olefinic materials are low molecular weight alpha-olefins or polymeric olefins. Of these polymers, one group is the polypropylene or butylene polymers. A number of the substituted succinic acids and anhydrides are commercially available.

Thiophosphoric acid esters are commonly the reaction products of $P_2S_5$ with alcohols. The reaction of $P_2S_5$ with alcohols is well known from the manufacture of zinc dialkyl or diaryl dithiophosphate. See for example U.S. Pat. No. 4,113,634 which describes the reaction of about 4 moles of hydroxy compound with one mole of phosphorus pentasulfide at a temperature from about 100 degrees F. (38 degrees C.) to about 250 degrees F. (121 degrees C.) Esters of $H_3PO_4$ are also commonly made by reacting alcohols with $H_3PO_4$ at well known conditions. Most commonly, these esters comprise mono- or di-esters of $C_1$, to about $C_{20}$ alcohols. A wide range of alcohols can be used for the various esterification reactions, with many having from about one to about twenty carbon atoms. Preferably, the alcohol contains about one to about ten carbon atoms. The alcohol provides a hydrocarbyl group to the phosphoric or thio phosphoric acid ester which enhances its oil solubility and the oil solubility of the final reaction product of basic compound with acidic compound. The hydrocarbyl can be saturated, unsaturated, branched, straight chain, or aromatic and also have various substitutions such as chlorine, bromine, amino, nitro, acid groups and the like so long as such substitution is not detrimental to reaction of basic compound with acidic compound and is not detrimental to the final product. Some alcohols are methyl, ethyl, propyl, butyl, pentyl, heptyl, octyl, decyl, dodecyl or branched chain alcohols such as methyl or ethyl branched isomers of the above. Primary and secondary alcohols are typically employed. Representative branched alcohols are isopropyl, 2-methyl-1-1-pentanol, 2-ethyl-1-hexanol, 2,2-dimethyl-1-octanol, and alcohols prepared from olefin oligomers such as propylene dimer or trimer by hydroboration-oxidation or by the Oxo process. One might use mixtures of alcohols because of their low cost and possible improvements in performance. One particular compound made from alcohols comprises O,O'-dibutyl phosphoric acid.

Some representative aromatic alcohols are phenol and substituted phenol comprising about 6 to about 20 carbon atoms. Common substituted phenols contain hydrocarbyl groups such as alkyl, alkenyl, aryl, aralkyl or alkaryl. Mono alkyl substitution is typically employed. The hydrocarbon substitution can range from low molecular weight groups such as methyl, ethyl, propyl, isopropyl, butyl, isobutyl, and the like up to low molecular weight polymers and copolymers. Many commercially available substituted phenols contain $C_8$ -$C_{12}$ substituents from polypropylene or polybutene. The hydrocarbyl substituted phenol may have other substituents, such as for example, chlorine, bromine, nitro, amine, acid groups and the like.

The lubricating oils in which the anti-wear additives of this invention are useful and which comprise a major proportion of the lubricating oil compositions may be of synthetic, animal, vegetable, or mineral origin. Ordinarily, mineral lubricating oils are typically used by reason of their availability, general excellence, and low cost. For certain applications, oils belonging to one of the other three groups may be preferred. For instance, synthetic polyester oils such as didodecyl adipate and di-2-ethylhexyl sebacate are often used as jet engine lubricants. Normally, the lubricating oils will be fluid oils, ranging in viscosity from about 40 Saybolt Universal Seconds at 100 degrees F. to about 200 Saybolt Universal Seconds at 210 degrees F. This invention contemplates also the presence of other additives in lubricating compositions. Such additives include, for example, dispersants, viscosity index improving agents, pour point depressing agents, anti-foam agents, extreme pressure agents, rust-inhibiting agents, and oxidation and corrosion inhibiting agents.

The base oil can be naphthenic oil, paraffinic oil, aromatic oil, or a synthetic oil such as a polyalphaolefin polyolester, diester, polyalkyl ethers, polyaryl ethers, silicone polymer fluids, or combinations thereof. The viscosity of the base oil can range from 50 to 10,000 SUS at 100 F.

Other hydrocarbon oils can also be used, such as: (a) oil derived from coal products, (b) alkylene polymers, such as polymers of propylene, butylene, etc., (c) olefin (alkylene) oxide-type polymers, such as olefin (alkylene) oxide polymers prepared by polymerizing alkylene oxide (e.g., propylene oxide polymers, etc., in the presence of water or alcohols, e.g., ethyl alcohol), (d) carboxylic acid esters, such as those which were prepared by esterifying such carboxylic acids as adipic acid, azelaic acid, suberic acid, sebacic acid, alkenyl succinic acid, fumaric acid, maleic acid, etc., with alcohols such as butyl alcohol, hexyl alcohol, 2-ethylhexyl alcohol, etc., (e) liquid esters of acid of phosphorus, (f) alkyl benzenes, (g) polyphenols such as biphenols and terphenols, (h) alkyl biphenol ethers, and (i) polymers of silicon, such as tetraethyl silicate, tetraisopropyl silicate, tetra(4-methyl-2-tetraethyl) silicate, hexyl(4-methol-2-pentoxy) disilicone, poly(methyl) siloxane and poly(methyl)phenylsiloxane.

In one embodiment, the base oil comprises about 65% by weight of a refined, solvent-extracted, hydrogenated, dewaxed base oil, preferably 850 SUS oil, and about 35% by weight of another refined solvent-extracted dewaxed base oil, preferably 150 SUS oil, for better results. Type II, II+, and III base are the frequently employed.

Thickeners useful in the lubricating grease include polyurea, calcium soaps (simple and complex), lithium soaps (simple and complex), and aluminum soaps (simple and complex). Polyurea thickeners are often employed over other types of thickeners because they have high dropping points, typically 460 degrees F. to 500 degrees F., or higher. Polyurea thickeners are also advantageous because they have inherent antioxidant characteristics, work well with other antioxidants, and are compatible with all elastomers and seals.

The calcium base material used in the thickener can be calcium oxide, calcium carbonate, calcium bicarbonate, calcium hydroxide, or any other calcium containing substance which, when reacted with a monocarboxylic acid or monocarboxylic acid derivative, provides a calcium carboxylate thickener.

The grease used in this invention, in general, comprises by weight: 45% to 90% base oil and 2% to 20% thickener, with the balance being made up by other additives as well as the mixed base phenate and/or sulfonate of this invention. If present, the amount of the polymer is from 1% to 10% of adhesive polymer. When the grease is thickened substantially by polyurea, triurea, biurea, calcium soaps (simple or complex), lithium soaps (simple or complex), or aluminum soaps (simple or complex), or combinations thereof, the lubricating grease typically comprises by weight 3% to 14% of said thickener. In one embodiment, the lubricating grease comprises by weight 4% to 8% of said thickener.

The mixed base phenate and/or sulfonate additives and/or compositions containing the mixed base anti-wear additive may be complemented by the addition of small amounts of an antioxidant and a corrosion inhibiting agent, as well as dyes and pigments to impart a desired color to the composition.

Antioxidants or oxidation inhibitors prevent varnish and sludge formation and oxidation of metal parts. Typical antioxidants are organic compounds containing nitrogen, such as organic amines, sulfides, hydroxy sulfides, phenols, etc., alone or in combination with metals like zinc, tin, or barium, as well as phenyl-alpha-naphthyl amine, bis(alkylphenyl) amine, N,N diphenyl-p-phenylenediamine, 2,2,4 trimethyldihydroquinoline oligomer, bis(4 isopropylaminophenyl)-ether, N-acyl-p-aminophenol, N-acylphenothiazines, N of ethylenediamine tetraacetic acid, and alkylphenol-formaldehyde-amine polycondensates.

Corrosion inhibiting agents or anticorrodants prevent rusting of iron by water, suppress attack by acidic bodies, and form protective film over metal surfaces to diminish corrosion of exposed metallic parts. A typical corrosion inhibiting agent is an alkali metal nitrite, such as sodium nitrite. Other ferrous corrosion inhibitors include metal sulfonate salts, alkyl and aryl succinic acids, and alkyl and aryl succinate esters, amides, and other related derivatives. Borated esters, amines, ethers, and alcohols can also be used with varying success to limit ferrous corrosion. Likewise, substituted amides, imides, amidines, and imidazolines can be used to limit ferrous corrosion. Other ferrous corrosion inhibitors include certain salts of aromatic acids and polyaromatic acids, such as zinc naphthenate.

Metal deactivators can also be added to further prevent or diminish copper corrosion and counteract the effects of metal on oxidation by forming catalytically inactive compounds with soluble or insoluble metal ions. Typical metal deactivators include mercaptobenzothiazole, complex organic nitrogen, and amines. Although such metal deactivators can be added to the grease, their presence is not normally required due to the extreme nonreactive, noncorrosive nature of the railroad track/wheel flange grease composition.

The sulfates used in the anti-wear additives of this invention are of Group 2a alkaline earth metal, such as beryllium, magnesium, calcium, strontium, and barium, or the sulfates of a Group al alkali metal, such as lithium, sodium, and potassium.

The carboxylates used in the anti-wear additives of this invention are of Group 2a alkaline earth metal, such as beryllium, magnesium, calcium, strontium, and barium, or a Group la alkali metal, such as lithium, sodium, and potassium. The carboxylates are of a Group 2a alkaline earth metal or of a Group 1a alkali metal such as those described above. A representative example of such carboxylates includes calcium acetate.

The phosphates used in the anti-wear additives of this invention are of a Group 2a alkaline earth metal, such as beryllium, manganese, calcium, strontium, and barium, or of a Group 1a alkali metal, such as lithium, sodium, potassium, rubidium, cesium, and francium. For example, monocalcium phosphate, dicalcium phosphate, and tricalcium phosphate can be employed in the practice of this invention.

The mixed base phenate and/or sulfonate additives can further comprise calcium hydroxide. A relatively minor level of calcium hydroxide, when added to the oil or grease, may improve the wear resistance properties. Also, the calcium hydroxide provides additional excess alkaline reserve which can be useful to help neutralize any acidic products which may result from high temperature oxidation of the grease over long periods of time. Preferably, the calcium hydroxide, when present, should be present at 0.01% to 5% by weight of the grease.

In any of the above-described forms of the lubricating grease, boron-containing oil separation inhibitors can be optionally added. It was found that borates or boron-containing materials such as borated amine, when used in greases in the presence of calcium phosphates and calcium carbonates, act as an oil separation inhibitor, which is especially useful at high temperatures. Such useful borated additives and inhibitors include: (1) borated amine, such as is sold under the brand name of Lubrizol 5391 by the Lubrizol Corp., and (2) potassium triborate, such as a microdispersion of potassium triborate in mineral oil sold under the brand name of OLOA 9750 by the Oronite Additive Division of Chevron Company. Other useful borates include borates of Group la alkali metals, borates of Group 2a alkaline earth metals, stable borates of transition metals (elements), such as zinc, copper, and tin, boric oxide, and combinations of the above. These borated materials may also be used when soap thickeners or mixtures of polyurea and soap thickeners are used. When boron-containing oil separation inhibitors are used in the grease they should be present at 0.01% to 10%, preferably 0.1% to 5%, and most preferably 0.25% to 2.5% , by weight of the boron-containing material in the total grease. Inorganic borate salts, such as potassium triborate, provide an oil separation inhibiting effect similar to borated amines when used in polyurea greases in which calcium phosphate and calcium carbonate are also present. It is believed that the physio-chemical reason for this oil separation inhibiting effect is similar to that for borated amines.

Other solid additives in particle form, including nanoparticles of metal carbonate, metal carboxylate, metal phosphate and/or metal sulfate, may be used in this invention in addition to the mixed base overbased phenates and/or sulfonate containing carbonates, carboxylates, phosphates and sulfates. Such other solid additives include but are not limited graphite, molybdenum disulfide, and TEFLON polymers.

What is claimed is:

1. An anti-wear composition, comprising:

(a) a phenate and a sulfonate; and (b) a base composition comprising a combination of a metal sulfate, a metal carboxylate, a metal phosphate, and a metal carbonate;

wherein the weight ratio of metal sulfate, metal carboxylate, metal phosphate, and metal carbonate, individually, to the total amount of other base present is each 1:1000 to 1000:1;

wherein the phenate is a calcium phenate having a total base number from about 100 to about 600;

wherein the sulfonate is a magnesium or calcium sulfonate having a total base number from about 100 to about 500;

wherein the phenate and the sulfonate are overbased with the base composition to provide an overbased phenate and an overbased sulfonate;

wherein the metal sulfate, metal carboxylate and metal phosphate are all reaction products of the metal carbonate; and further additionally including metal sulphate particles, metal carboxylate particles, metal phosphate particles, and metal carbonate particles added to said overbased phenate and overbased sulfonate, wherein the metal sulphate particles, the metal carboxylate particles, the metal phosphate particles, and the metal carbonate particles are each nanoparticles.

2. A lubricant composition, comprising:

(a) a phenate and a sulfonate, wherein the phenate is a calcium phenate having a total base number from about 100 to about 600, and the sulfonate is a magnesium or calcium sulfonate having a total base number from about 100 to about 500; and (b) a base composition comprising a combination of a metal sulfate, a metal carboxylate, a metal phosphate, and a metal carbonate, wherein the phenate and the sulfonate are overbased with the base composition to provide an overbased phenate and an overbased sulfonate, wherein the weight ratio of metal sulfate, metal carboxylate, metal phosphate, and metal carbonate, individually, to the total amount of other base present is each 1:1000 to 1000:1;

wherein the metal sulfate, metal carboxylate and metal phosphate are all reaction products of the metal carbonate; and further additionally including metal sulphate particles, metal carboxylate particles, metal phosphate particles, and metal carbonate particles added to said overbased phenate and overbased sulfonate, wherein the metal sulphate particles, the metal carboxylate particles, the metal phosphate particles, and the metal carbonate particles are each nanoparticles; and a lubricating oil or a grease.

3. The composition of claim 2, wherein the total amount of (a) and (b) is about 0.01 to about 50 weight percent based on the total weight of the composition.

4. The composition of claim 2, wherein the total amount of (a) and (b) is about 0.05 to about 20 weight percent based on the total weight of the composition.

5. The composition of claim 2, wherein the total amount of (a) and (b) is about 0.5 to about 5 weight percent based on the total weight of the composition.

6. A method of manufacturing an anti-wear composition, comprising:

combining (a) a phenate and a sulfonate, wherein the phenate is a calcium phenate having a total base number from about 100 to about 600, and the sulfonate is a magnesium or calcium sulfonate having a total base number from about 100 to about 500; and (b) a base composition comprising a combination of a metal sulfate, a metal carboxylate, a metal phosphate, and a metal carbonate, wherein the phenate and the sulfonate are overbased with the base composition to provide an overbased phenate and an overbased sulfonate, and wherein the weight ratio of metal sulfate, metal carboxylate, metal phosphate, and metal carbonate, individually, to the total amount of other base present is each 1:1000 to 1000:1;

wherein the metal sulfate, metal carboxylate and metal phosphate are all reaction products of the metal carbonate; and adding metal sulphate particles, metal carboxylate particles, metal phosphate particles, and metal carbonate particles to said overbased phenate and overbased sulfonate, wherein the metal sulphate particles, the metal carboxylate particles, the metal phosphate particles, and the metal carbonate particles are each nanoparticles.

7. The method of claim 6, further comprising combining (a) and (b) with a lubricating oil or a grease.

8. The method of claim 7, wherein the total amount of (a) and (b) is about 0.01 to about 50 weight percent based on the total weight of the composition.

9. The method of claim 7, wherein the total amount of (a) and (b) is about 0.05 to about 20 weight percent based on the total weight of the composition.

10. The method of claim 7, wherein the total amount of (a) and (b) is about 0.5 to about 5 weight percent based on the total weight of the composition.

11. The composition of claim 1 further comprising an antioxidant.

12. The composition of claim 1 further comprising an anticorrodant.

13. The composition of claim 1 further comprising a metal deactivator.

14. The composition of claim 1 further comprising calcium hydroxide.

15. The composition of claim 1 further comprising at least one of borate or boron.

16. An anti-wear composition, consisting essentially of:

(a) a phenate and a sulfonate; and (b) a base composition comprising a combination of a metal sulfate, a metal carboxylate, a metal phosphate, and a metal carbonate;

wherein the weight ratio of metal sulfate, metal carboxylate, metal phosphate, and metal carbonate, individually, to the total amount of other base present is each 1:1000 to 1000:1;

wherein the phenate is a calcium phenate having a total base number from about 100 to about 600;

wherein the sulfonate is a magnesium or calcium sulfonate having a total base number from about 100 to about 500;

wherein the phenate and the sulfonate are overbased with the base composition to provide an overbased phenate and an overbased sulfonate;

wherein the metal sulfate, metal carboxylate and metal phosphate are all reaction products of the metal carbonate; and further additionally including metal sulphate particles, metal carboxylate particles, metal phosphate particles, and metal carbonate particles added to said overbased phenate and overbased sulfonate, wherein the metal sulphate particles, the metal carboxylate particles, the metal phosphate particles, and the metal carbonate particles are each nanoparticles.

* * * * *